United States Patent [19]

Kubiatowicz

[11] 4,198,780

[45] Apr. 22, 1980

[54] WATER ACTIVATED TOY

[75] Inventor: James F. Kubiatowicz, Minneapolis, Minn.

[73] Assignee: Custom Concepts, Incorporated, Minneapolis, Minn.

[21] Appl. No.: 341,718

[22] Filed: Oct. 13, 1977

[51] Int. Cl.[2] ..... A63H 23/10

[52] U.S. Cl. ..... 46/92; 46/94

[58] Field of Search ..... 46/91, 92, 94; 119/5

[56] References Cited

U.S. PATENT DOCUMENTS

| | | | |
|---|---|---|---|
| 1,361,561 | 12/1920 | Yancey | 46/94 |
| 2,932,916 | 4/1960 | Strickland | 46/92 |
| 4,082,063 | 4/1978 | Strickland | 46/92 X |

*Primary Examiner*—Louis G. Mancene
*Assistant Examiner*—Mickey Yu
*Attorney, Agent, or Firm*—William L. Huebsch

[57] ABSTRACT

A toy adapted to be immersed in water and activated by gas generated by wetted baking powder in a cavity within the toy. The toy has a pocket disposed generally above the cavity and the center of gravity of the toy. The pocket is shaped to collect gas from the cavity so that the toy rises in the water and, when the collected gas bubble reaches a sufficient size or the toy reaches the surface of the water, the toy to tip so that the bubble will escape through an orifice at an edge of the pocket which allows the toy to again sink in the water. The cycle will repeat so that the toy repeatedly rises and sinks in the water.

7 Claims, 5 Drawing Figures

WATER ACTIVATED TOY

BACKGROUND OF THE INVENTION

This invention relates to toys of the type activated by gas released from wetted chemicals so that the toys will move vertically in a liquid in which they are immersed.

SUMMARY OF THE INVENTION

According to the present invention there is provided a simple inexpensive toy adapted to be activated by gas released from wetted chemicals to cause the toy to repeatedly rise and sink in a liquid.

The toy comprises walls of a density greater than the liquid including elongate wall portions defining an elongate chamber having first and second ends and having openings at each of its ends so that the chamber can be filled with a liquid (such as water) when the toy is immersed. Also included are means within the chamber adapted for receiving a chemical (such as baking powder) which will generate gas when wetted; means for wetting the chemical to generate gas and to allow the gas to escape within the chamber over an extended time period when the toy is immersed in liquid; and means for repeatedly collecting and releasing the gas to cause the toy to repeatedly rise and sink in the liquid.

The means for receiving and wetting the chemical comprise separable portions of the walls defining a cavity adapted to receive the chemical located generally centrally along the axis of the chamber and having an aperture adapted so that the liquid will enter and gas will escape the cavity through the aperture when the toy is submersed.

The means for repeatedly collecting and releasing the gas comprises portions of the walls projecting outwardly of the elongate wall portion to define a pocket opening into the chamber. The pocket can be disposed generally above the cavity and the center of gravity of the chamber when the chamber is horizontal so that gas excaping from the cavity will rise into and be collected in the pocket in a bubble of increasing size. The wall portions forming the pocket include a generally radially disposed end wall portion transverse of the chamber and adjacent its first end which limits movement of the side of the bubble toward that end of the chamber, and an end wall adjacent the second end of the chamber which is inclined so that the bubble will be maintained against the radially disposed end wall portion of the pocket. As the size of the gas bubble collected in the pocket increases, it will cause the toy to rise. Also the center of buoyancy of the bubble will shift along the inclined wall away from the toy's center of gravity until, apparently, the toy's center of gravity and center of buoyancy of the bubble separate sufficiently that the toy tips and allows the bubble to escape through an orifice at the end of the inclined wall adjacent the chamber. If the toy reaches the surface of the liquid before such tipping occurs, the loss of buoyancy of a portion of its first end that would then project above the water if the chamber were horizontal will apparently also cause the toy to tip and the gas bubble to escape. In either event, when the bubble escapes the toy will again sink and the chamber will return to horizontal, whereupon the cycle repeats.

To add to the enjoyment of the toy it may be shaped like a fish with the pocket being its dorsal fin, in the shape of a submarine with the pocket being its conning tower, or in the shape of any other object normally found underwater which has a central upwardly projecting portion in which the pocket can be formed.

BRIEF DESCRIPTION OF THE DRAWING

The invention will be further explained with reference to the accompanying drawing where like numbers refer to like parts in the several views, and wherein.

DESCRIPTION OF THE PREFERRED EMBODIMENT

Figure 1:
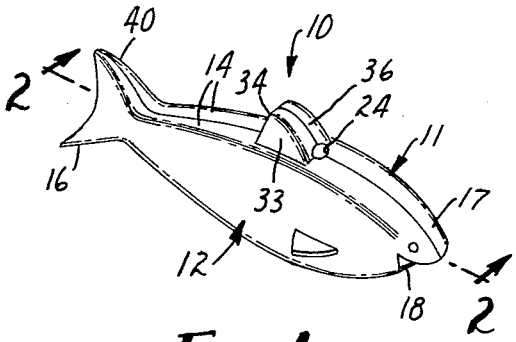
FIG. 1 is a perspective view of a toy according to the present invention.
Figure 2:
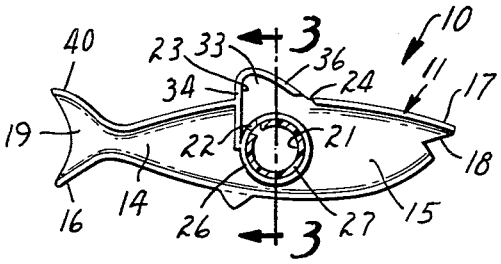
FIG. 2 is a sectional view taken along lines 2—2 of FIG. 1.
Figure 3:
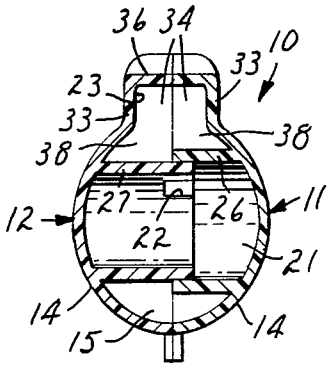
FIG. 3 is a sectional view taken along lines 3—3 of FIG. 2.

Referring now to the drawing there is shown a toy according to the present invention generally designated by the numeral 10.

The toy 10 comprises two molded releasably engageable generally ala chiro parts or walls 11 and 12 of a stiff polymeric material having a density greater than water (such as styrene), and having an external shape, when engaged, generally like that of a fish or shark. The parts 11 and 12 include elongate wall portions 14 defining, when engaged, an elongate chamber 15 having a first or tail end 16 and a second or head end 17 shaped respectively like the tail and head of a fish. The parts 11 and 12 have openings at each of said ends 16 and 17 including an opening 18 in the shape of a mouth at the head end 17 and an opening 19 in the center of the tail end 16. The openings 18 and 19 prevent air from being trapped so that water will fill the chamber 15 when the toy 10 is submersed in water with the chamber 15 generally vertically disposed.

The toy 10 comprises means defining a cavity 21 adapted for receiving a chemical (such as baking powder) which will release gas when wetted; means comprising an aperture 22 between the chamber 15 and cavity 21 for allowing water to enter the cavity 21 to wet the chemical and allowing gas generated within the cavity 21 to escape over an extended time period when the toy 10 is immersed in water; means defining a pocket 23 for collecting the gas generated during a part of that period within the toy 10 to cause the toy 10 to rise in water in which it is immersed; and means for releasing the collected gas through an orifice 24 after collection of a predetermined amount or when the toy 10 reaches the surface of the water to allow the toy to sink in the water so that the gas is again collected and the cycle is repeated.

Figure 4:
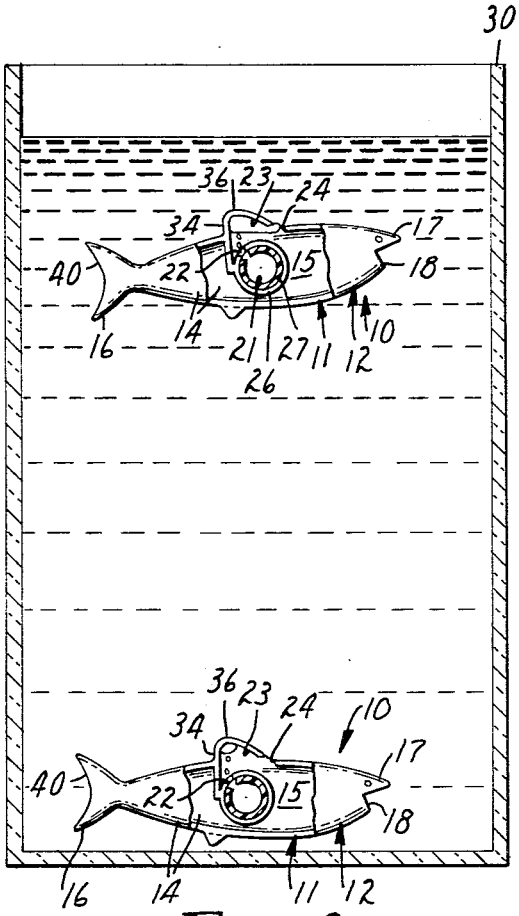
FIG. 4 is a view illustrating two positions for the toy of FIG. 1 as it repeatedly rises and sinks in a jar of water, with parts of the toy illustrations being broken away to show the condition of a gas bubble that operates the toy.
Figure 5:
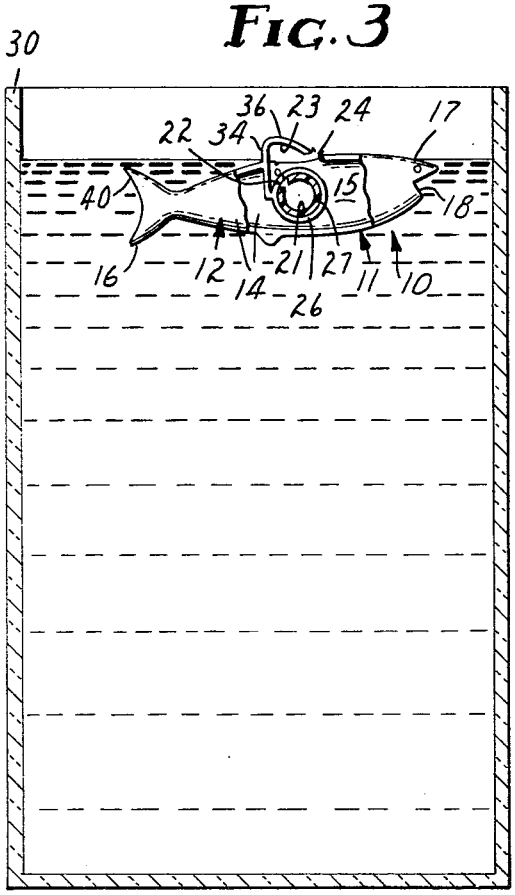
FIG. 5 is a view illustrating the toy of FIG. 1 at the surface of water in a jar in which it is being used which also has parts broken away to show the condition of a gas bubble that operates the toy.

The means defining a cavity 21 adapted for receiving the chemical comprises two tubular wall portions 26 and 27 extending transverse of the chamber 15 and adapted for releasable telescoping frictional engagement. When engaged, the tubular wall portions 26 and 27 define the cavity 21 in which the gas producing chemical may be received, and provide means for releasably holding together the parts 11 and 12 of the toy 10. Separating the tubular wall portions 26 and 27 (and thereby the parts 11 and 12) affords loading the chemical therein. The tubular wall portions 26 and 27 have slots extending inwardly from their distal edges which slots overlap when the tubular wall portions 26 and 27 are engaged to provide the aperture 22 communicating between the cavity 21 and the chamber 15 through which water can wet a chemical in the cavity 21 when the toy 10 is submersed (as in a jar of water 30 as is illustrated in FIGS. 4 and 5) and through which gas from the wetted chemical can escape into the chamber 15. The slots are disposed at about a 45 degree angle with respect to the centerline of the chamber so that gas from the cavity 21 will be discharged directly under the apex of the pocket 23. Preferably the slots are about 1/16 inch long axially of the tubular wall portions 26 and 27, 0.055 inch wide at their innermost end and have walls that diverge at an angle of about 45 degrees to facilitate movement of water into and gas out of the cavity 21.

The pocket 23 for retaining the gas released into the chamber 15 from the cavity 21 opens into the chamber 15 and is defined by wall portions projecting outwardly from the elongate wall portions 14 which are generally in the shape of a dorsal fin for a fish. These projecting wall portions include two opposed spaced side wall portions 33 disposed generally parallel to the central axis of the chamber 15, a radial end wall portion 34 adjacent the tail end 16 of the chamber 15 disposed generally radially and transverse of the chamber 15, and a sloping wall portion 36 having a curved slightly concave inner surface adjacent the head end 17 of the chamber 15. The sloping wall portion 36 is inclined from the outermost end of the pocket 23 toward the axis and head end 17 and of the chamber 15 and is also disposed transverse of the chamber 15. Also included are guide wall portions 38 extending between the tubular wall portions 26 defining the cavity 21 and the radial end wall portions 34 of the pocket 23 which insure that gas released from the cavity 21 will enter the pocket 23.

The pocket 23 is shaped so that as it collects gas discharged from the cavity 21, the bubble will first collect in the uppermost part of the pocket 23 adjacent the radial wall portions 34, as is illustrated in the lowermost toy 10 in FIG. 4. As more gas is collected and the bubble becomes larger it will fill more and more of the pocket 23. Its edge adjacent the tail end 16 will remain in contact with the radial end wall portions 34, however, so that the center of buoyancy of the bubble will move toward the head end 17 of the chamber 15 and away from the center of gravity of the toy 10. Apparently when the center of gravity of the toy 10 and the center of buoyancy of the bubble separate sufficiently, the tail end 16 of the toy 10 will tip downwardly relative to its head end 17 allowing the gas to escape through the orifice 24 at the base of the sloping wall portion 36, as is illustrated in the uppermost toy 10 of FIG. 4. If the toy 10 reaches the surface of the water before such release of the bubble, an upper section 40 of the tail end 16, which is spaced from the centerline of the chamber 15 a distance greater than the base of the pocket 23, will rise above the water. The loss of water buoyancy for that upper section 40 of the tail end 16 will apparently cause the toy to tip with the tail end 16 moving downwardly so that the bubble can escape through the orifice 24 as is illustrated for the toy in FIG. 5. In either event the toy 10 will sink, and the cycle will repeat.

A toy 10 having an overall length of 2¾ inch, a maximum diameter of about ⅝ inch, a pocket having inner dimensions about ¼ inch wide, projecting about ¼ inch above the wall portions 14 and having a sloping wall portion disposed at about 25 degrees to the axis of the chamber 15 has been found to work well in a jar of water 30 in the range of about 4 to 6 inches in diameter and filled with water to a depth of about 4 to 6 inches.

OPERATION

To actuate the toy 10, first the parts 12 and 13 are separate. The tubular wall portions 26 and 27 are both firmly packed full of baking powder as with the end of a pencil. A drop of water is then placed on the baking powder in one of the tubular wall portions 26 or 27 to start release of the gas, and the toy 10 is assembled by sliding the tubular wall portions 26 and 27 together. The toy 10 is then submersed in a container of water with the head end 17 down so that water will displace air from within the chamber 15 through the openings 18 and 19, including any gas that might be generated by baking powder spilled in the chamber 15. The toy 10 is then placed in the vessel of water with chamber 15 generally horizontally disposed and the pocket 23 uppermost in the position of the lowermost toy 10 of FIG. 4. As the gas is released from the cavity 21 through the aperture 22 it will be collected in the pocket 23 adjacent the radially disposed end wall portions 34. As the size of the bubble increases, it will cause the toy 10 to rise in the water while centering itself between the radially disposed end wall portions 34 and the sloped wall portions 36. As it does so the center of buoyancy of the bubble will move toward the head end 17 of the chamber 15 and away from the center of gravity of the toy 10, apparently causing the toy 10 to tip with its tail end 16 moving downwardly so the bubble can escape out of the orifice 24 in the bottom edge of the sloping wall portion 36 as is illustrated in the uppermost toy 10 in FIG. 4. If the toy reaches the surface of the water before such release of the gas occurs, the upper section 40 of the tail end 16 will rise above the water surface, whereupon the loss of buoyancy for that upper section 40 apparently will cause the toy 10 to tip with the tail end 16 moving down so that the bubble can escape through the orifice 24 as is illustrated in the toy 10 in FIG. 5. In either event the toy 10 will again sink, and the cycle will repeat causing the toy to repeatedly rise and sink in the water.

Often the toy 10 will move between two submerged positions when the baking powder is first activated, and will cycle to the surface after the baking powder becomes less active.

I claim:

1. A toy adapted to be activated by gas released from a wetted chemical to cause the toy to repeatedly rise and sink in a liquid in which it is submerged, said toy comprising walls of a material having a density greater than that of a said liquid and including:

elongate wall portions having first and second ends, defining an elongate chamber, and having an opening allowing liquid to enter said chamber when said toy is submerged therein;

projecting wall portions projecting outwardly from said elongate wall portion to define a pocket defining into said elongate chamber and centered generally over the center of gravity of said toy when said elongate chamber is horizontally disposed and said pocket is uppermost, said projecting wall portions including a generally radially extending wall portion adjacent the first end of said elongate wall portion and a sloping wall portion sloped from the outermost portion of said pocket toward the center of said chamber and said second end, both said radially extending wall portion and said sloping wall portion being disposed generally transverse of said elongate chamber and said sloping wall portion having an orifice through its end adjacent said second end; and wall portions defining a cavity within said chamber adjacent said pocket adapted to receive a said chemical and having an aperture between said cavity and chamber adjacent said pocket so that with said chamber horizontal and said pocket uppermost gas generated by the chemical within said chamber wetted through said aperture wall escape through said aperture and collect in the pocket in an enlarging bubble which enlarging bubble has one side retained against said radially projecting wall portion and an opposite side that moves along said sloping wall portion to shift the center of buoyancy of the bubble toward said second end away from the center of gravity of said toy so that the enlarging bubble will both cause the toy to rise in the liquid and the second end of the toy to lift upwardly relative to its first end until the bubble moves along the sloping wall portion and escapes through said orifice, the toy sinks and the cycle repeats.

2. A toy according to claim 1 wherein said toy consists of two walls, each comprising a tubular wall portion extending transverse of said chamber, said tubular wall portions being adapted for telescoping frictional engagement to releasably retain said wall together and define said cavity therebetween.

3. A toy according to claim 1 wherein said first end has a section spaced from the centerline of said chamber a distance greater than the base of said pocket so that when said toy reaches the surface of liquid in which it is submersed the lack of buoyancy on said section will cause the toy to tip and gas collected in said pocket to escape through said orifice.

4. A toy according to claim 1 wherein said elongate wall portions having an opening at each of said ends into said chamber.

5. A toy according to claim 1 wherein said material is styrene.

6. A toy according to claim 1 wherein said inclined wall portion is disposed at angle of about 25 degrees with the centerline of said chamber.

7. A toy according to claim 1 wherein said aperture has walls diverging at an angle of about 45 degrees from said cavity to said chamber.

* * * * *